US012766578B2

(12) United States Patent
Matsui et al.

(10) Patent No.: US 12,766,578 B2
(45) Date of Patent: Oct. 20, 2026

(54) WIPING APPARATUS AND ROLLING FACILITY

(71) Applicant: PRIMETALS TECHNOLOGIES JAPAN, LTD., Hiroshima (JP)

(72) Inventors: Yoichi Matsui, Hiroshima (JP); Yuta Odawara, Hiroshima (JP)

(73) Assignee: PRIMETALS TECHNOLOGIES JAPAN, LTD., Hiroshima (JP)

( * ) Notice: Subject to any disclaimer, the term of this patent is extended or adjusted under 35 U.S.C. 154(b) by 296 days.

(21) Appl. No.: 18/571,636

(22) PCT Filed: Jul. 26, 2021

(86) PCT No.: PCT/JP2021/027515
§ 371 (c)(1),
(2) Date: Dec. 18, 2023

(87) PCT Pub. No.: WO2023/007541
PCT Pub. Date: Feb. 2, 2023

(65) Prior Publication Data
US 2024/0278303 A1 Aug. 22, 2024

(51) Int. Cl.
*B21B 45/02* (2006.01)
*B21B 1/24* (2006.01)

(52) U.S. Cl.
CPC ..... *B21B 45/0278* (2013.01); *B21B 1/24* (2013.01)

(58) Field of Classification Search
CPC ..... B21B 45/0278; B21B 45/0275; B21B 45/0281; B21B 45/0284
See application file for complete search history.

(56) References Cited

U.S. PATENT DOCUMENTS 4,601,112 A * 7/1986 Kush ..... B21B 45/0281 34/95
6,217,725 B1 * 4/2001 Van Anglen ..... C25D 17/008 204/207

FOREIGN PATENT DOCUMENTS

| | | | | |
|---|---|---|---|---|
| CN | 1618532 | A | | 5/2005 |
| CN | 212918781 | U | | 4/2021 |
| JP | 52-162235 | U | | 12/1977 |
| JP | 1-130808 | A | | 5/1989 |
| JP | H01127607 | U | * | 8/1989 |
| JP | 2-118606 | U | | 9/1990 |
| JP | 11-47817 | A | | 2/1999 |
| JP | 2000-210710 | A | | 8/2000 |
| JP | 2019-25532 | A | | 2/2019 |

OTHER PUBLICATIONS

Translation of JP-H01127607.*
International Search Report for PCT/JP2021/027515 mailed on Oct. 12, 2021.

(Continued)

*Primary Examiner* — Bobby Yeonjin Kim
(74) *Attorney, Agent, or Firm* — Birch, Stewart, Kolasch & Birch, LLP

(57) ABSTRACT

A wiping apparatus for removing a liquid from a surface of a strip of metal being conveyed includes a first wiping member disposed to be contactable with a rolled face of the strip. The first wiping member has an oblique portion extending in a direction oblique to a strip width direction of the strip.

15 Claims, 11 Drawing Sheets

(56) References Cited

OTHER PUBLICATIONS

International Preliminary Report on Patentability and Written Opinion of the International Searching Authority for International Application No. PCT/JP2021/027515, dated Feb. 8, 2024, with an English translation.
Chinese Office Action and Search Report for Chinese Application No. 202180099962.5, dated Mar. 24, 2026, with English translation of the Office Action.

* cited by examiner

WIPING APPARATUS AND ROLLING FACILITY

TECHNICAL FIELD

The present disclosure relates to a wiping apparatus and a rolling facility.

BACKGROUND

In a rolling facility for rolling a metal strip, rolling is performed while supplying liquid coolant to a mill roll. If the coolant remains on a surface of the rolled strip, it may become a quality problem. Therefore, a wiping apparatus for removing a liquid, such as coolant, from the surface of the strip has been proposed.

Patent Documents 1 and 2 each describe a wiping apparatus that includes a stationary (contact-type) wiper extending in a direction orthogonal to a conveying direction of a metal strip and disposed so as to contact a surface of the strip, downstream of a mill roll for rolling the strip.

CITATION LIST

Patent Literature

Patent Document 1: JPH1-130808A
Patent Document 2: JP2019-25532A

SUMMARY

Technical Problem

Compared to a roll-type wiper, the stationary (contact-type) wiper has an advantage that, for example, the liquid, such as the coolant, removed from the surface of the strip by the wiper hardly splashes into a surrounding area or the wiper and the strip contact more evenly in a strip width direction, and thus unevenness in wiping hardly occurs.

On the other hand, in general, in the stationary wiper, the liquid, such as the coolant, removed from the surface of the strip by the wiper tends to accumulate upstream of the wiper. If the liquid contains a foreign matter, such as metal powder generated by wear of the mill roll or the strip or wear debris generated by wear of the wiper, mixed in the coolant, the foreign matter also accumulates upstream of the wiper and becomes a lump. The foreign matter thus accumulates may scratch the surface of the strip.

In view of the above, an object of at least one embodiment of the present invention is to provide a rolling facility and a wiping apparatus which hardly scratches a surface of a metal strip.

Solution to Problem

A wiping apparatus according to at least one embodiment of the present invention is a wiping apparatus for removing a liquid from a surface of a strip of metal being conveyed, including: a first wiping member disposed to be contactable with a rolled face of the strip. The first wiping member has an oblique portion extending in a direction oblique to a strip width direction of the strip.

Further, a rolling facility according to at least one embodiment of the present invention, includes: a mill roll for rolling a strip of metal; and the above-described wiping apparatus disposed downstream of the mill roll in a conveying direction of the strip.

Advantageous Effects

According to at least one embodiment of the present invention, provided are a rolling facility and a wiping apparatus which hardly scratches a surface of a metal strip.

DETAILED DESCRIPTION

Figure 1:
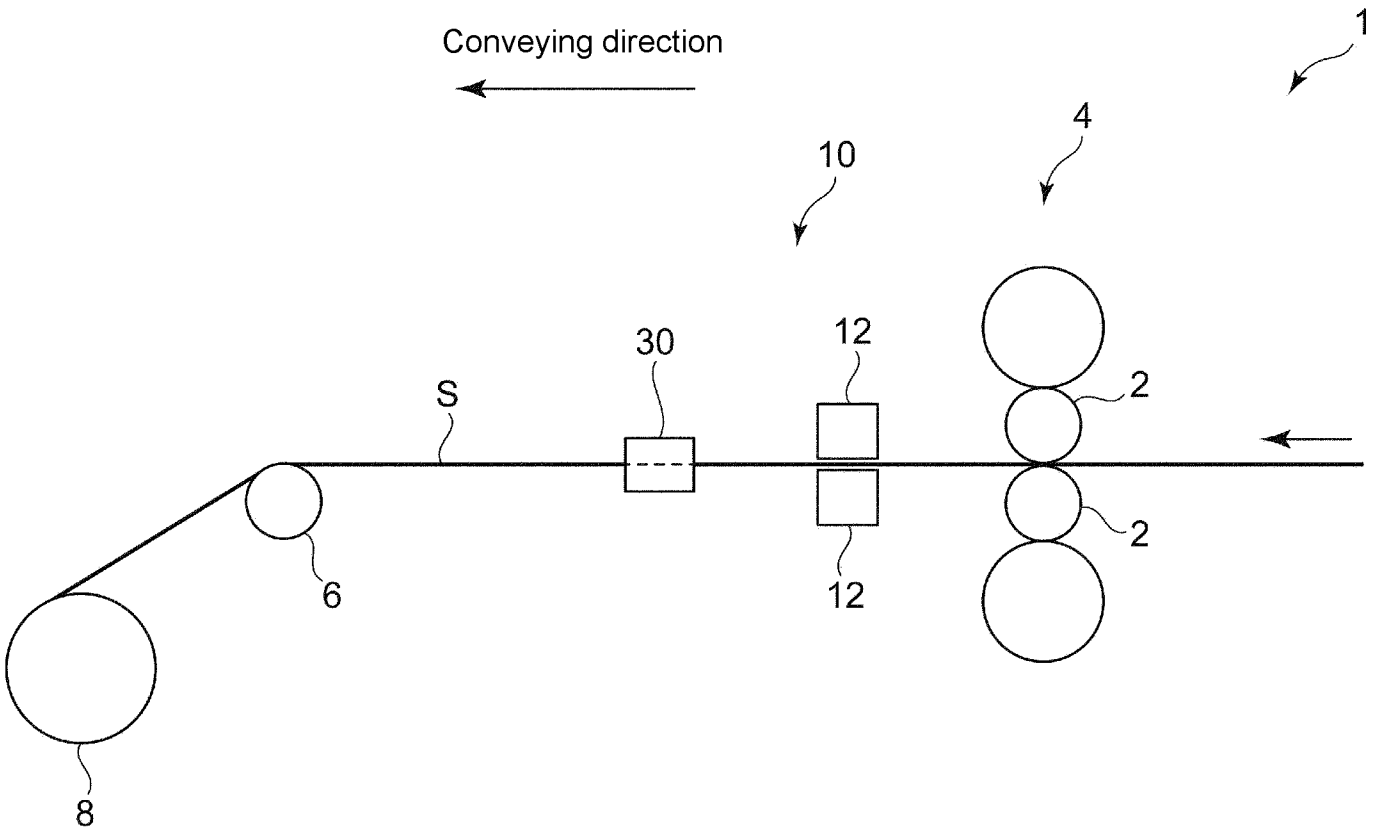
FIG. 1 is a schematic view of a rolling facility including a wiping apparatus according to an embodiment.

Some embodiments of the present invention will be described below with reference to the accompanying drawings. It is intended, however, that unless particularly identified, dimensions, materials, shapes, relative positions and the like of components described or shown in the drawings as the embodiments shall be interpreted as illustrative only and not intended to limit the scope of the present invention.

Figure 2:
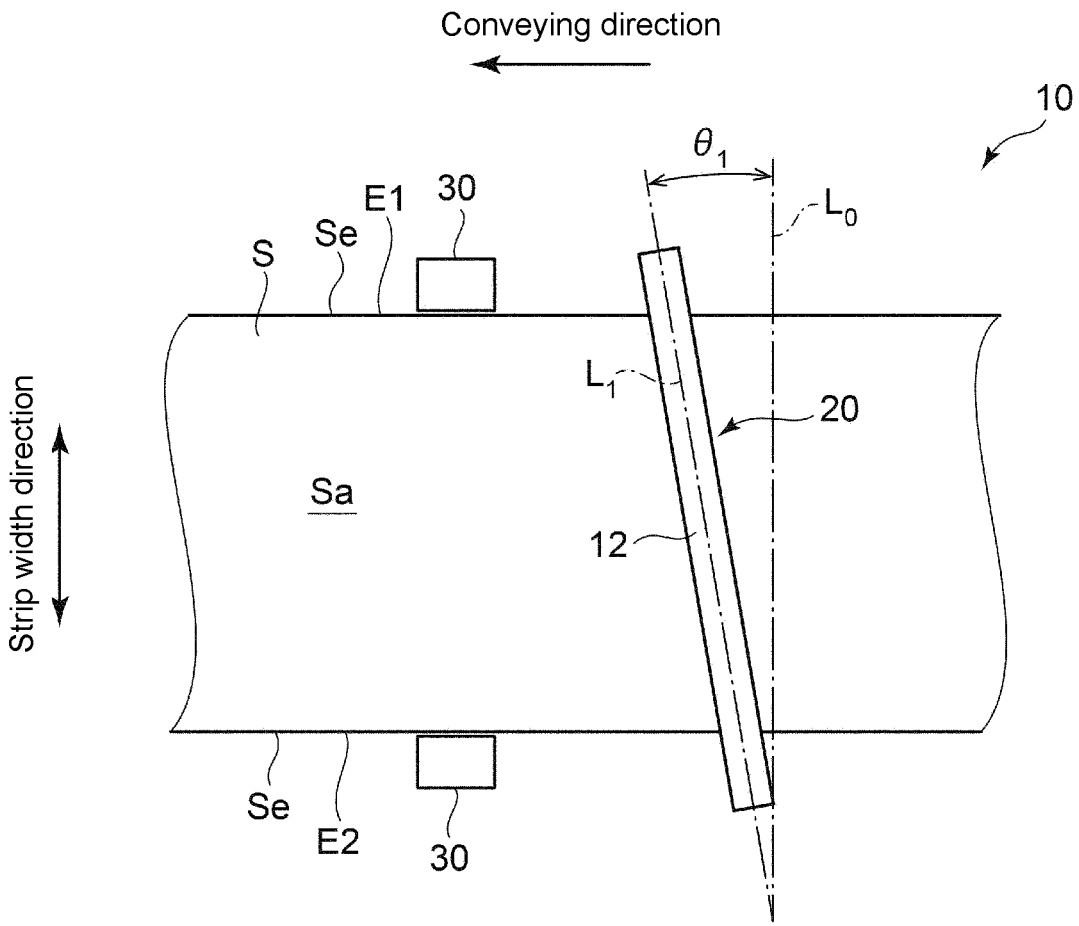
FIG. 2 is a schematic planar view of the wiping apparatus in the rolling facility shown in FIG. 1.

FIG. 1 is a schematic view of a rolling facility including a wiping apparatus according to some embodiments. FIG. 2 is a schematic planar view of the wiping apparatus in the rolling facility shown in FIG. 1. Further, FIGS. 5 to 9 are each a schematic planar view of the wiping apparatus 10 according to an embodiment.

As shown in FIG. 1, a rolling facility 1 according to an embodiment includes a rolling mill 4 including mill rolls 2 for rolling a strip S of metal (steel, etc.), and a wiping apparatus 10 disposed downstream of the mill rolls 2 in a conveying direction of the strip S. As shown in FIG. 1, the rolling facility 1 may include a winding device 8 for winding the strip S rolled by the mill rolls 2, and may include a guide roll 6 disposed between the mill rolls 2 and the winding device 8 and configured to guide the strip S to the mill rolls 2. The wiping apparatus 10 may be disposed between the mill rolls 2 and the winding device 8 in the conveying direction of the strip S.

In the rolling mill 4, rolling is performed while supplying liquid coolant to the mill rolls 2. Thus, the coolant adheres to the surface of the strip S that has passed through the mill rolls 2. The wiping apparatus 10 is a wiping apparatus for removing a liquid, such as the coolant, from the surface of the strip S by wiping.

In some embodiments, the wiping apparatus 10 includes a first wiping member 12 disposed to be contactable with the surface of the strip S. Herein, FIG. 3 is a schematic cross-sectional view of the first wiping member 12 in the rolling facility 1 shown in FIG. 1.

Figure 3:
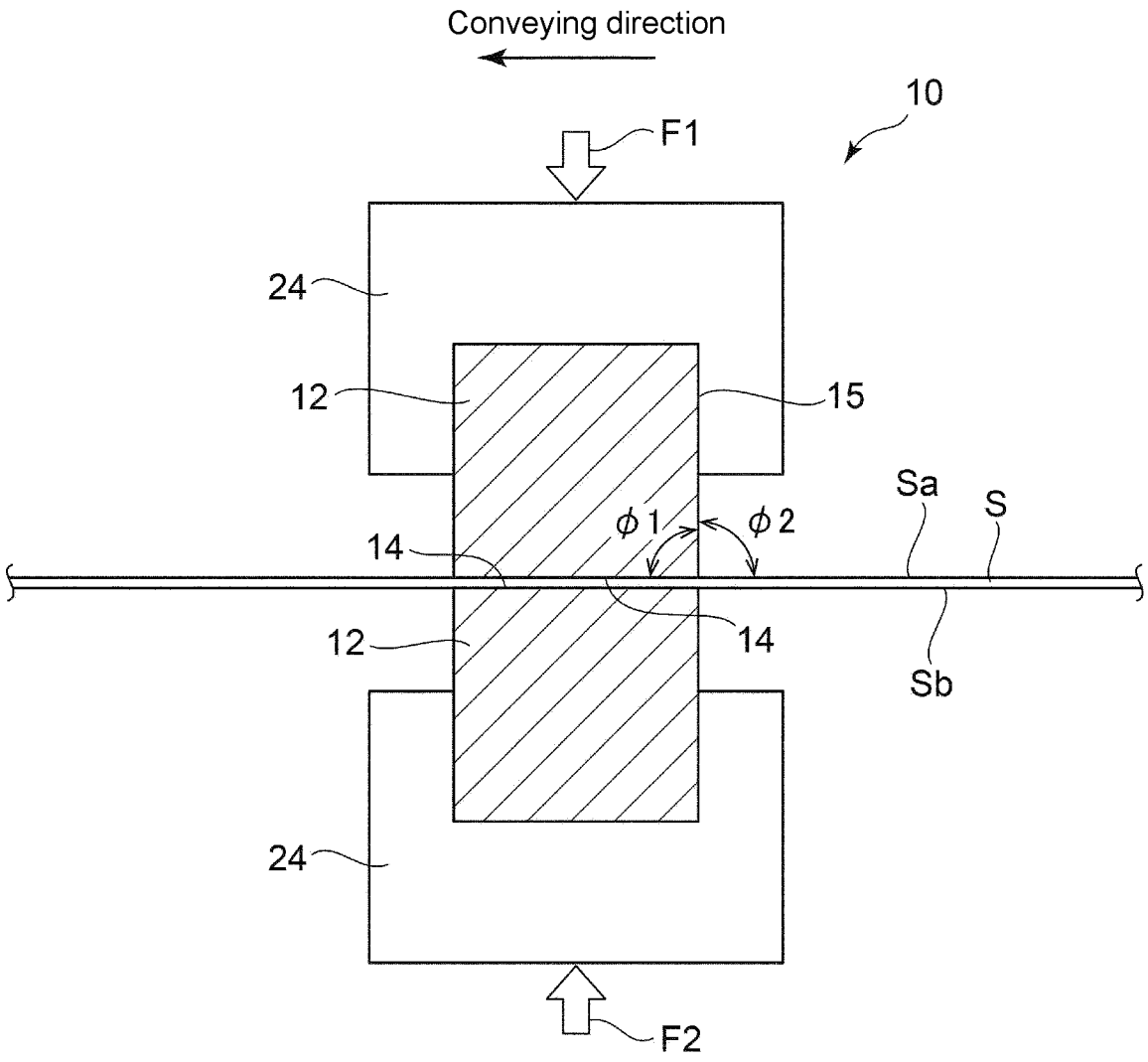
FIG. 3 is a schematic cross-sectional view of a first wiping member in the rolling facility shown in FIG. 1.

As shown in FIGS. 1 and 3, the first wiping member 12 is disposed to be contactable with a rolled face Sa or Sb of the strip S. In the illustrated embodiments, the wiping apparatus 10 includes the first wiping members 12, 12 contactable with the upper rolled face Sa and the lower rolled face Sb of the strip S, respectively. In the illustrated embodiments, each of the first wiping members 12 has a flat face 14 contactable with the rolled face Sa or Sb.

The rolled face Sa, Sb of the strip S means, of the surface of the strip S, a face to be rolled by the mill rolls 2 or a face rolled by the mill rolls 2 (a face in contact with outer circumferential surfaces of the mill rolls 2).

As shown in FIG. 2 and FIGS. 5 to 9, the first wiping member 12 has an oblique portion 20 extending in a direction oblique to the strip width direction of the strip S. In the exemplary embodiment shown in FIG. 2, the whole of the first wiping member 12 is the oblique portion 20 extending in the direction oblique to the strip width direction of the strip S. In the exemplary embodiments shown in FIGS. 5 to 9, the first wiping member 12 includes a first oblique portions 20A (oblique portion 20) and a second oblique portion 20B (oblique portion 20) which are different from each other in extension direction.

The wiping apparatus 10 may include a pressing part configured to press the first wiping member 12 toward the rolled face Sa, Sb of the strip S. The flat face 14 of the first wiping member 12 can be brought into contact with the surface of the strip S by pressing the first wiping member 12 against the strip S with the pressing part. The pressing part may include, for example, a hydraulic cylinder or a pneumatic cylinder, or an elastic member such as a spring.

Further, as shown in FIG. 3, the wiping apparatus 10 may include a holding member 24 holding the first wiping member 12. The above-described pressing part may apply pressing forces (forces to press the first wiping member 12 against the strip S) F1, F2 to the first wiping member 12 via the holding member 24.

In general, in the stationary wiper, the liquid, such as the coolant, removed from the surface of the strip by the wiper tends to accumulate upstream of the wiper. If the liquid contains a foreign matter, such as metal powder generated by wear of the mill roll or the strip or wear debris generated by wear of the wiper, mixed in the coolant, the foreign matter also accumulates upstream of the wiper and the thus accumulating foreign matter may scratch the surface of the strip.

In this regard, according to the above-described embodiments, since the first wiping member 12 has the oblique portion 20 extending in the direction oblique to the strip width direction, the liquid removed from the surface of the strip S by the first wiping member 12 and the foreign matter contained in the liquid are less likely to accumulate upstream of the first wiping member 12 and more likely to be discharged along the oblique portion 20 of the first wiping member 12 toward lateral to the strip S. Therefore, according to the above-described embodiments, it is possible to facilitate discharge of the foreign matter (a solid matter (such as metal powder etc. generated by wear of the mill roll or the strip, or wear debris etc. of the wiping member) mixed in the coolant) contained in the liquid. Therefore, it is possible to effectively suppress the scratch on the surface of the strip S due to the foreign matter accumulating upstream of the first wiping member 12.

The oblique angles θ1, θ1A, θ1B (see FIG. 2 and FIGS. 5 to 9) of the extension direction (indicated by straight lines L1, L1A, L1B in FIG. 2 and FIGS. 5 to 9) of the oblique portions 20, 20A, 20B of the first wiping member 12 to the strip width direction (indicated by a straight line L0 in FIG. 2 and FIGS. 5 to 9) of the strip S may be, for example, not less than 1 degree and not greater than 45 degrees, or more preferably not less than 3 degrees and not greater than 10 degrees. Since the above-described oblique angle is not less than 1 degree or not less than 3 degrees, the liquid accumulating upstream of the first wiping member 12 can effectively be discharged along the first wiping member 12 toward lateral to the strip width direction. Further, since the above-described oblique angle is not greater than 45 degrees or not greater than 10 degrees, the length of the first wiping member 12 hardly becomes excessive, making it possible to suppress an increase in size of the wiping apparatus 10.

Figure 5:
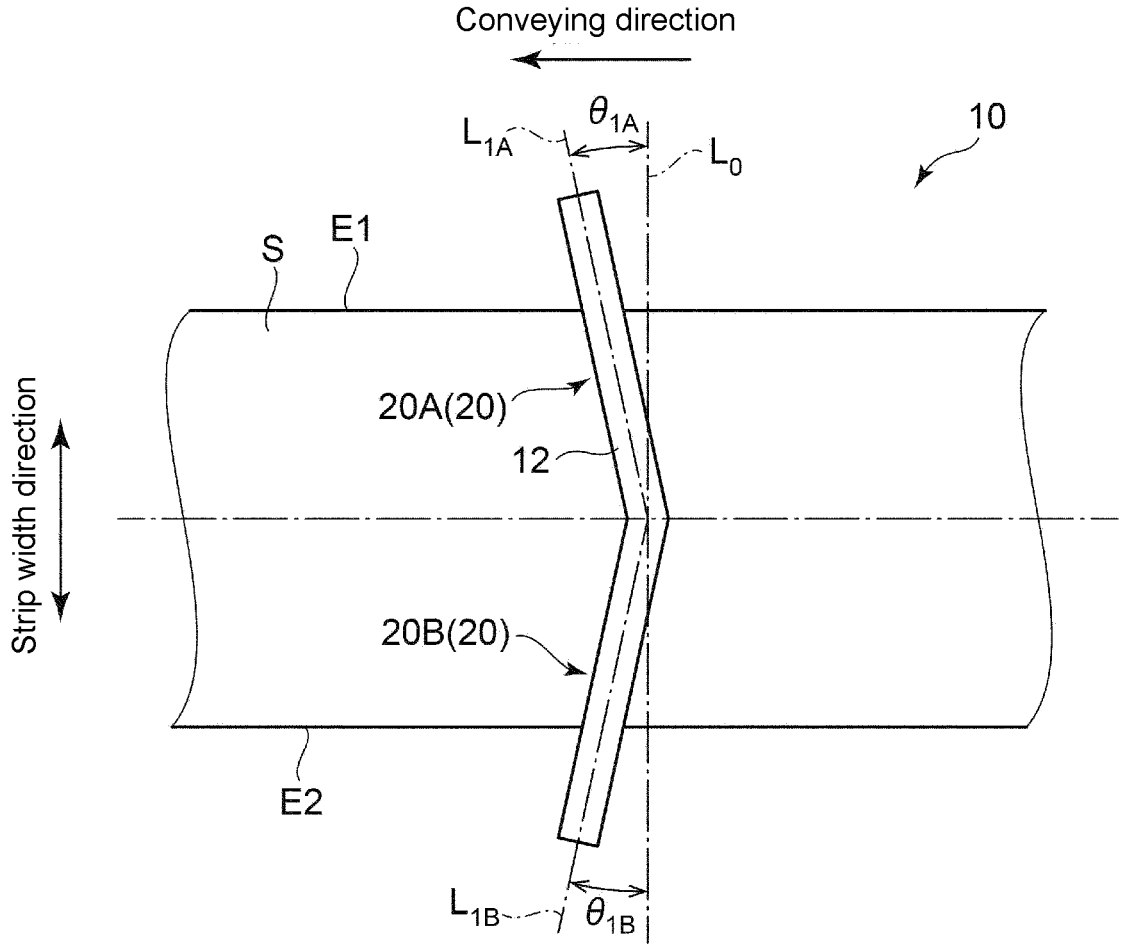
FIG. 5 is a schematic planar view of the wiping apparatus according to an embodiment.
Figure 7:
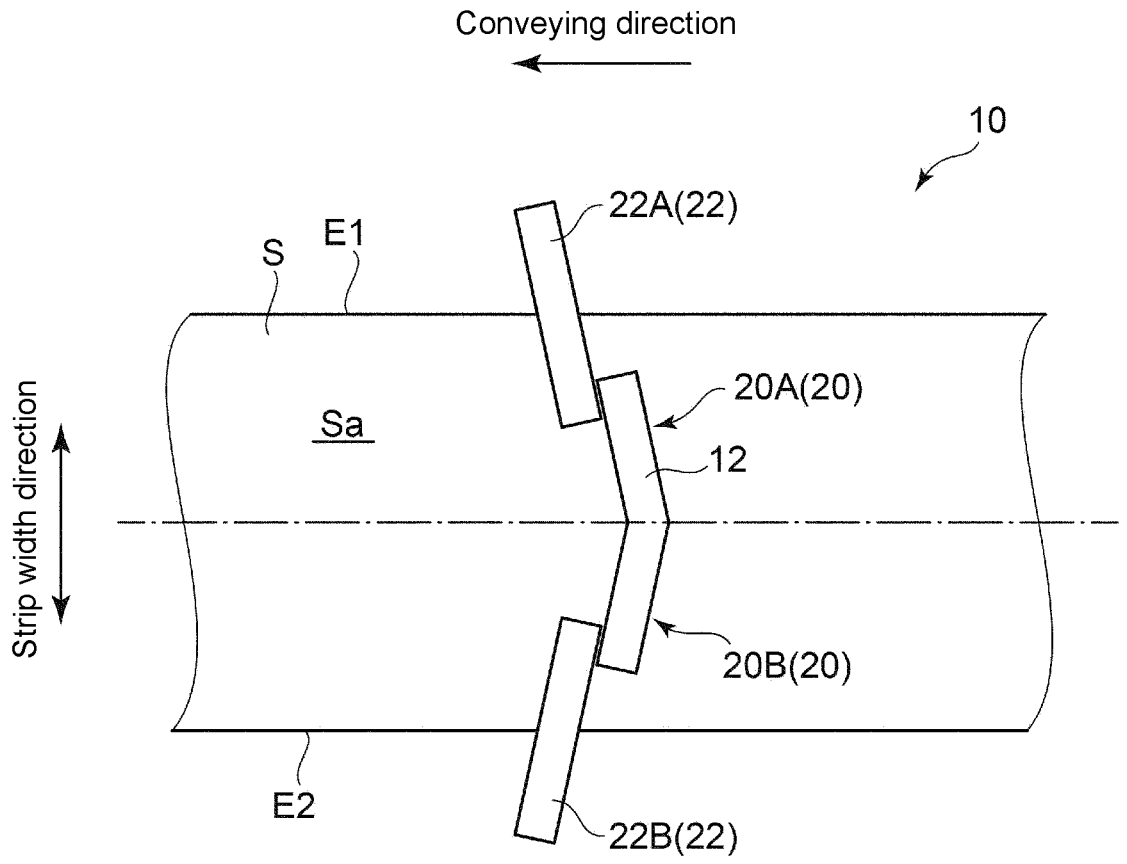
FIG. 7 is a schematic planar view of the wiping apparatus according to an embodiment.
Figure 8:
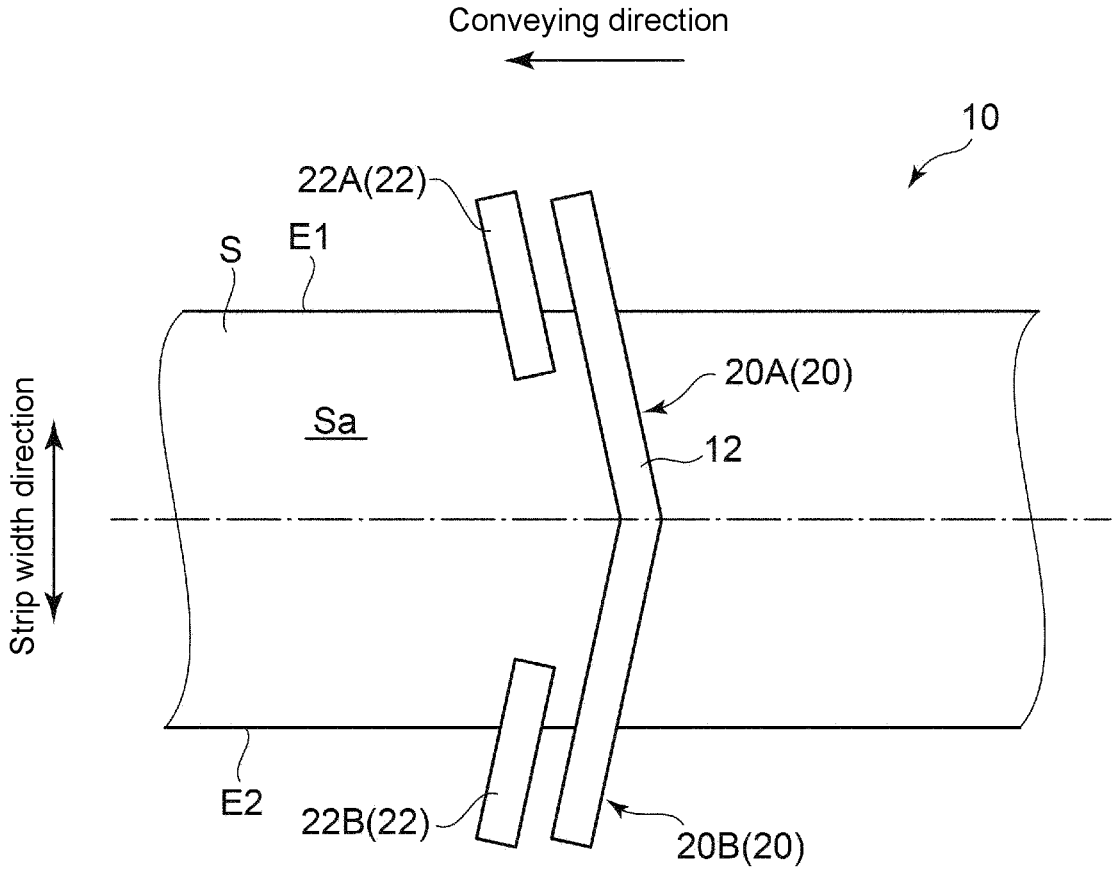
FIG. 8 is a schematic planar view of the wiping apparatus according to an embodiment.

In some embodiments, the first wiping member 12 may extend from a first end E1 to a second end E2 in the strip width direction of the strip S (see FIGS. 2, 5, and 8). Alternatively, in some embodiments, the first wiping member 12 may extend within a range between the first end E1 and the second end E2 of the strip S in the strip width direction of the strip S (that is, an end portion of the first wiping member 12 in the strip width direction may not reach the strip end (the first end E1 or the second end E2) of the strip S) (see FIGS. 6, 7, and 9).

The first wiping member 12 may be formed from a graphite fiber reinforced resin composite material. The graphite fiber reinforced resin composite material may include, for example, a polyimide graphite fiber reinforced composite (PGFC).

The graphite fiber reinforced resin composite material such as PGFC has self-lubricating properties and a low coefficient of friction with a metal material. Therefore, since the first wiping member 12 is formed from the graphite fiber reinforced resin composite material, heat or wear due to friction between the first wiping member 12 and the strip S is hardly generated. Accordingly, since wear debris due to wear of the first wiping member 12 is hardly generated, it is possible to suppress the scratch on the surface of the strip S due to the wear debris.

Further, as in the above-described embodiments, by arranging the first wiping member 12 to be oblique to the strip width direction, the contact area between the first wiping member 12 and the strip S is increased compared to a case where the first wiping member 12 is arranged so as to extend in the strip width direction. In this regard, since the first wiping member 12 is formed from the graphite fiber reinforced resin composite material having the self-lubricating properties and the low coefficient of friction with the metal material, it is possible to effectively suppress the generation of heat or wear due to friction between the first wiping member 12 and the strip S even if the contact area between the first wiping member 12 and the strip S is increased.

In some embodiments, for example, as shown in FIGS. 5 to 9, the first wiping member 12 includes the first oblique portion 20A located on the first end E1 side of the strip S in the strip width direction, and the second oblique portion 20B located on the second end E2 side of the strip S in the strip width direction. The first oblique portion 20A extends in a direction oblique toward downstream in the conveying direction of the strip S, from the second end E2 side toward the first end E1 side in the strip width direction. The second oblique portion 20B extends in a direction oblique toward downstream in the conveying direction of the strip S, from the first end E1 side toward the second end E2 side in the strip width direction.

In the above-described embodiments, the first wiping member 12 includes the first oblique portion 20A located on the first end E1 side of the strip S and extending in the direction oblique toward downstream in the conveying direction of the strip S from the second end E2 side toward the first end E1 side in the strip width direction of the strip S, and the second oblique portion 20B located on the second end E2 side of the strip S and extending in the direction oblique toward downstream in the conveying direction of the strip S from the first end E1 side toward the second end E2 side in the strip width direction of the strip S. Therefore, the liquid removed from the surface of the strip S by the first wiping member 12 and the foreign matter contained in the liquid are more likely to be discharged along the first wiping member 12 toward both laterals to the strip S. Therefore, it is possible to effectively discharge the foreign matter contained in the liquid, making it possible to more effectively suppress the scratch on the surface of the strip S due to the foreign matter accumulating upstream of the first wiping member 12.

Figure 4:
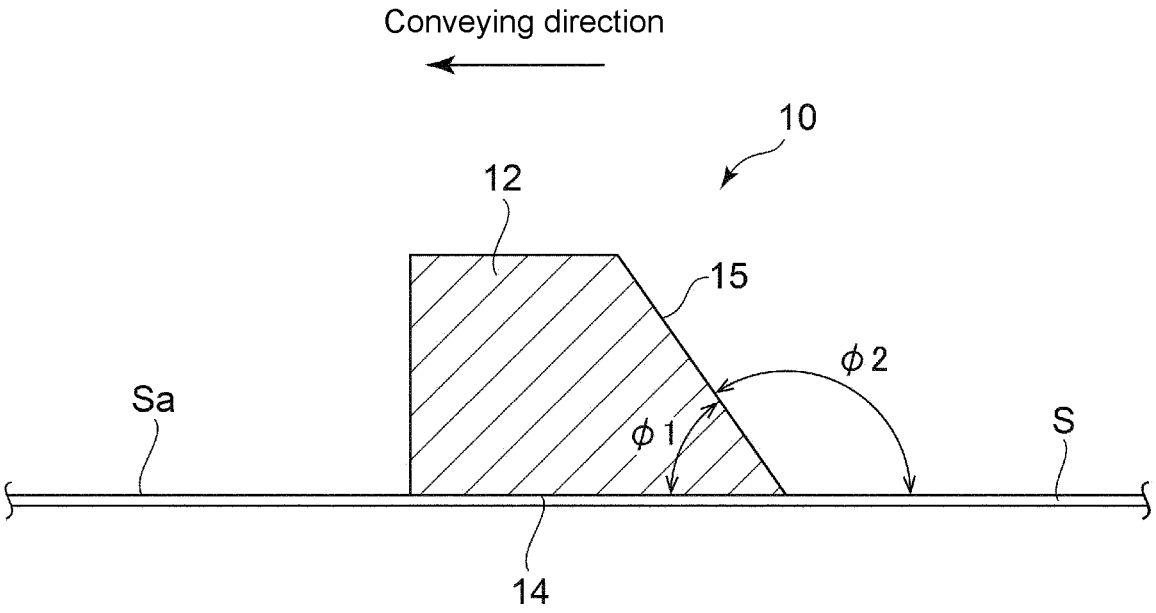
FIG. 4 is a schematic cross-sectional view of the first wiping member in the rolling facility according to an embodiment.

FIG. 4 is a schematic cross-sectional view of the first wiping member 12 in the rolling facility 1 according to an embodiment. In some embodiments, for example, as shown in FIG. 4, the first wiping member 12 has an upstream face 15 connected to the flat face 14 at an upstream end of the flat face 14 in the conveying direction of the strip S. Then, an angle φ1 between the flat face 14 and the upstream face 15 is greater than 0 degrees and less than 90 degrees in a cross section orthogonal to the strip width direction of the strip S.

In the above-described embodiments, the angle φ1 between the flat face 14 and the upstream face 15 of the first wiping member 12 is greater than 0 degrees and less than 90 degrees in the cross section orthogonal to the strip width direction. That is, an angle φ2 (see FIG. 4) between the upstream face 15 of the first wiping member 12 and a portion, of the rolled face (in FIG. 4, the rolled face Sa) of the strip S, upstream of the first wiping member 12 is an obtuse angle in the above-described cross section. Therefore, compared to a case where the angle φ2 is not greater than 90 degrees, the liquid, such as the coolant, and the foreign matter (the solid matter (such as metal powder etc. generated by wear of the mill roll or the strip, or wear debris etc. of the first wiping member 12) mixed in the coolant) contained in the liquid are easily discharged from a region between the upstream face 15 of the first wiping member 12 and the rolled face of the strip S. Therefore, it is possible to facilitate the discharge of the liquid and the foreign matter from the above-described region, and it is possible to more effectively suppress the scratch on the surface of the strip S due to the foreign matter.

In the embodiment shown in FIG. 3, the angle φ1 and the angle φ2 described above are approximately 90 degrees.

In some embodiments, the wiping apparatus 10 may include a first drive part (not shown) for moving the first wiping member 12 along the strip width direction. The first drive part may include a hydraulic cylinder, a pneumatic cylinder, or a motor.

According to the above-described embodiments, by moving, along the strip width direction, the first wiping member 12 extending along the direction oblique to the strip width direction, the liquid accumulating upstream of the first wiping member 12 and the foreign matter contained in the liquid can be pushed out toward lateral to the strip S. Therefore, it is possible to more effectively discharge the foreign matter contained in the liquid, and it is possible to more effectively suppress the scratch on the surface of the strip S due to the foreign matter accumulating upstream of the first wiping member 12.

Further, according to the above-described embodiments, when the first wiping member 12 partially contacts the strip S in the strip width direction (for example, see FIGS. 2, 5, and 8), a portion of the first wiping member 12 contacting the strip S can be changed by moving the first wiping member 12 along the strip width direction with the first drive part. Therefore, a portion of the first wiping member 12 which is subject to wear due to friction with the strip S can be dispersed, making it possible to extend the lifetime of the first wiping member 12.

In some embodiments, for example, as shown in FIGS. 6 to 9, the wiping apparatus 10 includes a second wiping member 22 (22A, 22B) disposed to be contactable with the rolled face Sa or Sb of the strip S in a region including an end portion of the strip S in the strip width direction (a portion, of the strip S, including the first end E1 or the second end E2 in the strip width direction). In the exemplary embodiments shown in FIGS. 6 to 9, the wiping apparatus 10 includes the second wiping member 22A disposed to be contactable with the rolled face of the strip S in the region including the end portion of the strip S on the first end E1 side, and the second wiping member 22B disposed to be contactable with the rolled face of the strip S in the region including the end portion of the strip S on the second end E2 side.

According to the above-described embodiments, since the wiping apparatus 10 includes the first wiping member 12, and the second wiping member 22 disposed in the region including the end portion of the strip S in the strip width direction (end portion region), it is possible to individually replace the first wiping member 12 and the second wiping member 22. Therefore, only the worn wiping member (the first wiping member 12 or the second wiping member 22) can selectively be replaced, making it possible to suppress cost compared to a configuration that requires replacement of the entire wiping member.

Figure 9:
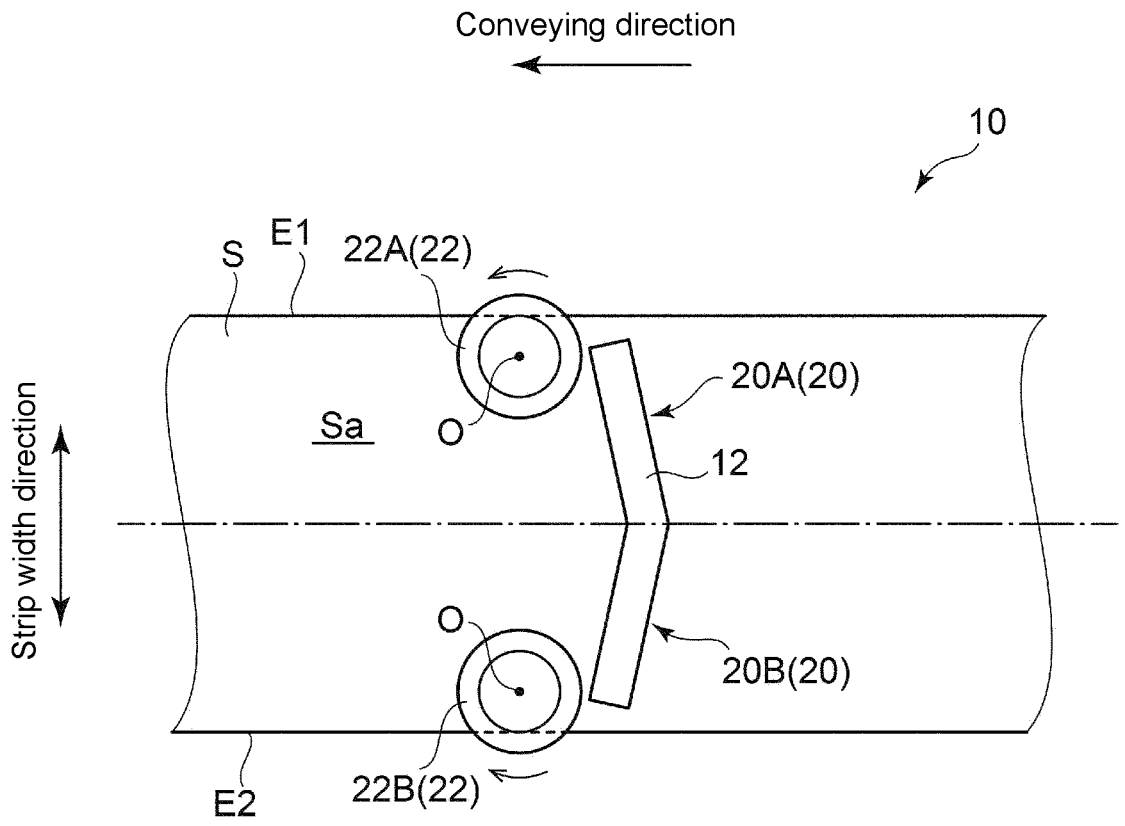
FIG. 9 is a schematic planar view of the wiping apparatus according to an embodiment.

In some embodiments, for example, as shown in FIGS. 7 to 9, the second wiping members 22 (22A, 22B) are disposed downstream of the first wiping member 12 in the conveying direction of the strip, and are disposed so as to partially overlap the first wiping member 12 in the strip width direction.

According to the above-described embodiments, since the second wiping members 22 (22A, 22B) are disposed so as to partially overlap the first wiping member 12 in the strip width direction, it is possible to improve wiping efficiency in the end portion region of the strip S.

Figure 6:
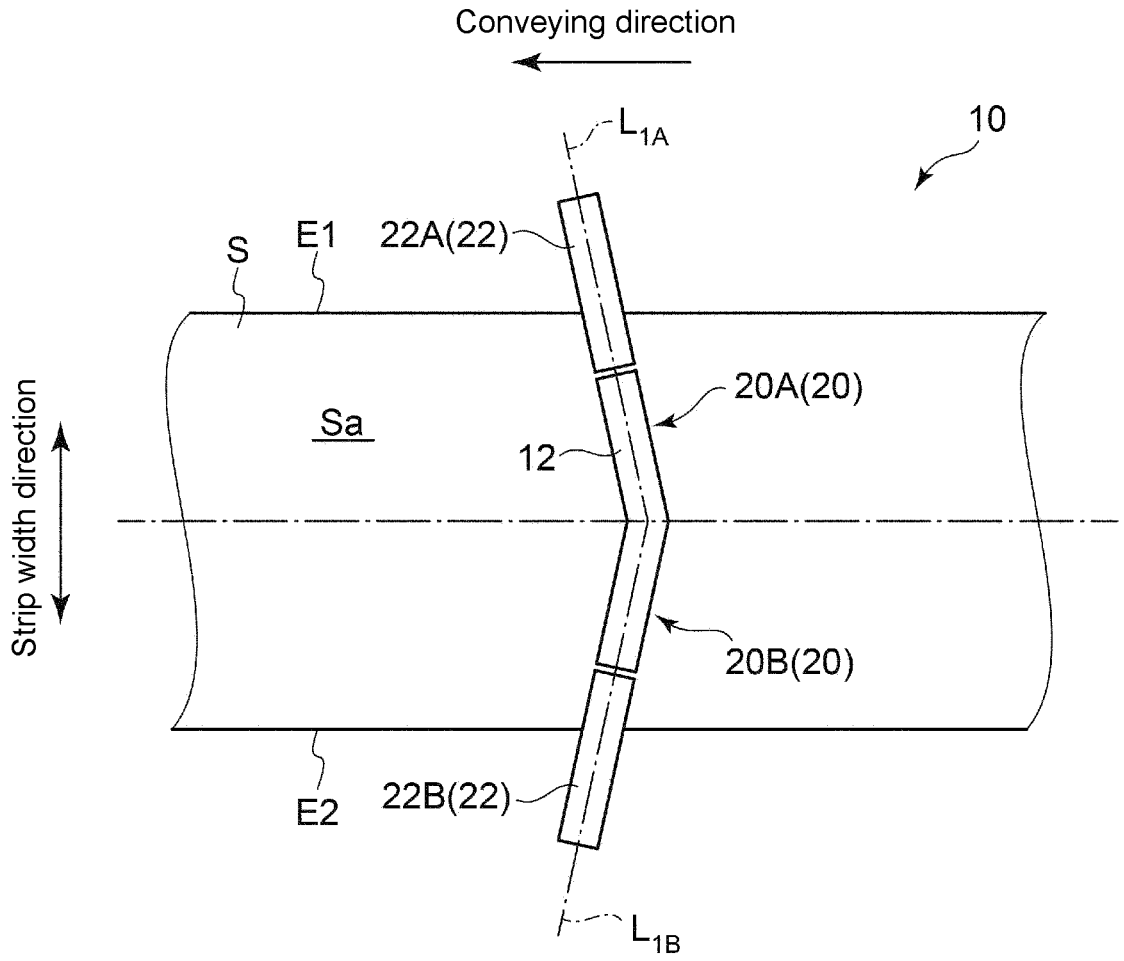
FIG. 6 is a schematic planar view of the wiping apparatus according to an embodiment.

In some embodiments, for example, as shown in FIG. 6, the second wiping members 22 (22A, 22B) are disposed adjacent to the first wiping member 12 in the extension direction of the first wiping member 12. In the exemplary embodiment shown in FIG. 6, the second wiping member 22A disposed on the first end E1 side in the strip width direction is disposed adjacent to the first oblique portion 20A (first wiping member 12) in the extension direction (the direction of the straight line L1A) of the first oblique portion 20A of the first wiping member 12, and the second wiping member 22B disposed on the second end E2 side in the strip width direction is disposed adjacent to the second oblique portion 20B (first wiping member 12) in the extension direction (the direction of the straight line L1B) of the second oblique portion 20B of the first wiping member 12.

According to the above-described embodiment, it is possible to obtain the wiping apparatus 10 with the simple configuration in which the first wiping member 12 and the second wiping member 22 are adjacent to each other in the extension direction of the first wiping member 12. Therefore, for example, it is possible to easily perform maintenance of the wiping apparatus 10.

In some embodiments, the wiping apparatus 10 may include a second drive part (not shown) for moving the second wiping member 22 along the strip width direction. The second drive part may include a hydraulic cylinder, a pneumatic cylinder, or a motor.

According to the above-described embodiments, a worn portion of the second wiping member 22 can be dispersed by moving the second wiping member 22 along the strip width direction with the second drive part. Therefore, it is possible to reduce the replacement frequency of the second wiping member 22.

In some embodiments, for example, as shown in FIGS. 6 to 8, the second wiping member 22 is a rod-shaped member extending along the strip width direction of the strip S.

In some embodiments, for example, as shown in FIG. 9, the second wiping member 22 has a circular cross-sectional contour along the horizontal direction. The cross-sectional shape of the second wiping member 22 along the horizontal direction may be a ring shape as shown in FIG. 9, or may be a disk shape.

According to the above-described embodiments, since the second wiping member 22 has the circular cross-sectional contour along the horizontal direction, the end portion region of the strip S can be wiped more widely.

In some embodiments, the second wiping member 22 is disposed to be rotatable around a rotational axis O (see FIG. 9) along the vertical direction. In this case, it is possible to disperse the worn portion of the second wiping member 22. Therefore, it is possible to reduce the replacement frequency of the second wiping member 22. The second wiping member 22 may rotationally be driven by a drive device such as a motor. Alternatively, the second wiping member 22 may be co-rotated by friction with the strip S.

As shown in FIGS. 1 and 2, the wiping apparatus 10 may include a third wiping member 30 disposed to be contactable with the end face Se of the strip S in the strip width direction. Herein, the end faces Se of the strip S in the strip width direction mean, of the surface of the strip S, the faces connecting the pair of rolled faces Sa, Sb (the upper rolled face Sa and the lower rolled face Sb) of the strip S to each other at the both end portions of the strip S in the strip width direction.

Since the third wiping member 30 contactable with the end face Se of the strip S in the strip width direction is thus provided, it is possible to effectively remove the liquid adhering to the end face Se of the strip S in the strip width direction.

Figure 10:
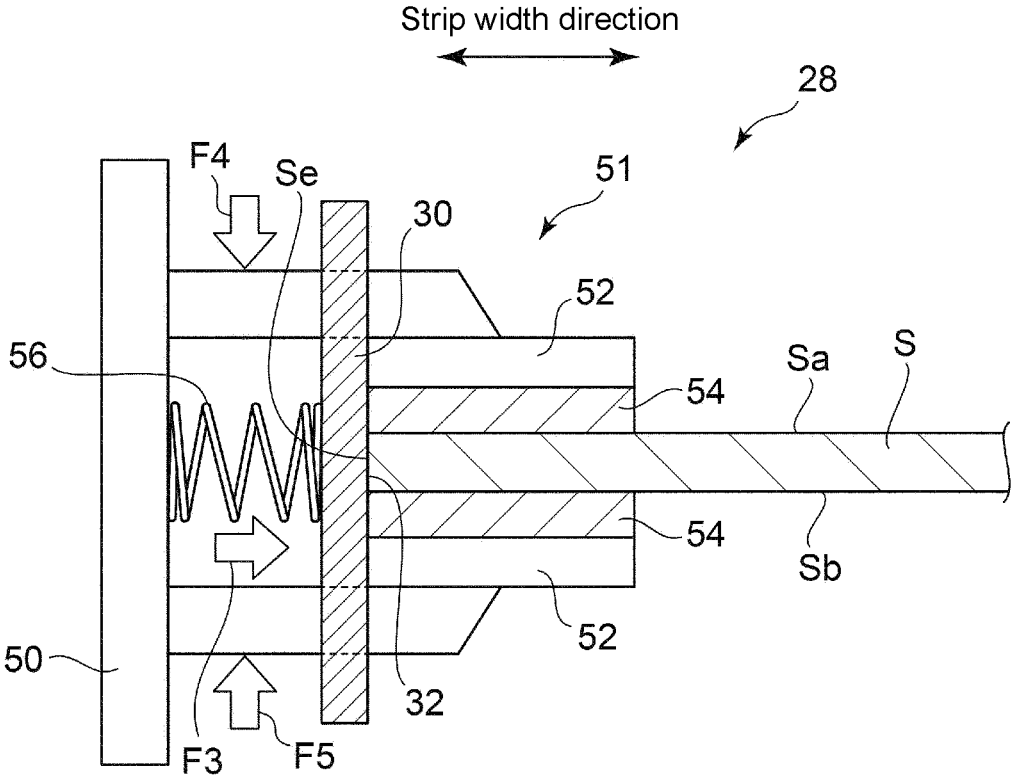
FIG. 10 is a schematic cross-sectional view of a side wiper of the wiping apparatus according to an embodiment.
Figure 11:
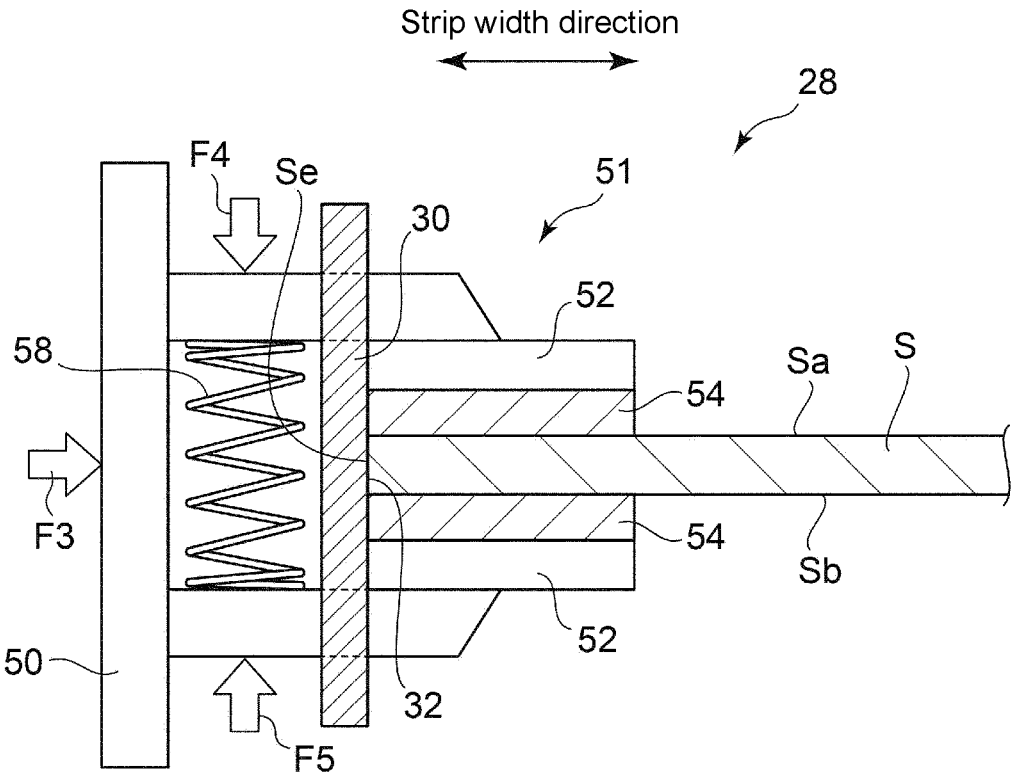
FIG. 11 is a schematic cross-sectional view of the side wiper of the wiping apparatus according to an embodiment.

FIGS. 10 and 11 are each a schematic cross-sectional view of a side wiper 28 of the wiping apparatus 10 according to an embodiment. The side wiper 28 is a wiper including the above-described third wiping member 30. FIGS. 10 and 11 are the views showing cross sections of the side wiper 28 at mutually different positions in the conveying direction of the strip S.

As shown in FIGS. 10 and 11, the side wiper 28 has the third wiping member 30 which is contactable with the end face Se of the strip S in the strip width direction. The third wiping member 30 has a flat face 32 which is contactable with end face Se of the strip S. The third wiping member 30 may be formed from a graphite fiber reinforced resin composite material. The graphite fiber reinforced resin composite material may include, for example, a polyimide graphite fiber reinforced composite (PGFC).

The side wiper 28 has a flat plate part 50 extending along the strip thickness direction of the strip S, and the third wiping member 30 of the side wiper 28 is supported by the flat plate part 50 via a spring 56 (first elastic member; see FIG. 10). The spring 56 corresponds to the pressing part, and a pressing force F3 (a force to press the third wiping member 30 against the end face Se of the strip S) from the pressing part (spring 56) is applied to the third wiping member 30. In the case of a facility that processes only the strip S of approximately constant width, the flat plate part 50 may be fixed and immobile. However, since most facilities need to process the strips S of various widths, it is preferable to provide a conveying device (not shown) that allows for slide movement of the flat plate part 50 in the strip width direction of the strip S.

As shown in FIGS. 10 and 11, the side wiper 28 may include a clamping part 51 supported by the flat plate part 50 and configured to clamp the strip S from the strip thickness direction. The clamping part 51 shown in FIGS. 8 and 9 includes a pair of clamping members 52, 52 disposed on both sides of the strip S (the upper side and the lower side of the strip S) in the strip thickness direction. Between the pair of clamping members 52, 52, a spring 58 (second elastic member; see FIG. 11) is provided to apply, to the pair of clamping members 52, 52, a biasing force in a direction in which the pair of clamping members are separated from each other. Further, an actuator (not shown) is also provided to apply, to the pair of clamping members 52, 52, forces F4, F5 opposite in direction to the biasing force of the spring 58.

A portion 54, of the pair of clamping members 52, 52, facing the strip S may be formed from the graphite fiber reinforced resin composite material. The graphite fiber reinforced resin composite material may include the polyimide graphite fiber reinforced composite (PGFC).

As described above, according to the configuration where the third wiping member 30 is disposed which is contactable with the end face Se of the strip S in the strip width direction, the liquid, such as the coolant, adhering to the end face Se of the strip S in the strip width direction can effectively be removed by the third wiping member 30. Further, since the third wiping member 30 is formed from the graphite fiber reinforced resin composite material having the self-lubricating properties and the low coefficient of friction with metal material, the end face Se of the strip S is hardly scratched when the end face Se is wiped, and the replacement frequency of the third wiping member 30 can be reduced.

Further, in the above-described embodiments, since the third wiping member 30 is pressed toward the end face Se of the strip S by the spring 56 (first elastic member), even if the strip S moves in the strip width direction due to, for example, meandering of the strip S, the third wiping member 30 follows the movement of the strip S, making it possible to maintain a state where the third wiping member 30 is in contact with the end face Se of the strip S. Therefore, the liquid adhering to the end face Se of the strip S in the strip width direction can be removed more reliably.

Further, in the above-described embodiments, a posture of the third wiping member 30 with respect to the strip S can be stabilized by clamping the strip S from the strip thickness direction by the clamping part 51 supported by the flat plate part 50. Whereby, the state where the third wiping member 30 is in contact with the end face Se of the strip S is maintained easily, the liquid adhering to the end face Se of the strip S in the strip width direction can be removed more reliably.

Further, in the above-described embodiments, the strip S can be clamped with the clamping part 51 from the strip thickness direction by operating the actuator to apply a force greater than the biasing force of the spring 58 (second elastic member) to the clamping members 52, 52. Furthermore, the clamping of the strip S with the clamping part 51 can be released by operating the actuator and making the force applied by the actuator to the clamping members 52, 52 smaller than the biasing force of the spring 58 (second elastic member).

In some embodiments, for example, as shown in FIGS. 1 and 2, the third wiping member 30 is disposed downstream of the first wiping member 12 in the conveying direction of the strip S.

According to the above-described embodiments, since the third wiping member 30 for wiping the end face Se of the strip S in the strip width direction is disposed downstream of the first wiping member 12 for wiping the rolled faces Sa, Sb of the strip S, the liquid, such as the coolant, laterally discharged from the rolled faces Sa, Sb of the strip S by the first wiping member 12 and adhering to the end face Se of the strip S can effectively be removed by the third wiping member 30.

In some embodiments, the third wiping member 30 is disposed downstream of the first wiping member 12 extending from the first end E1 to the second end E2 in the strip width direction of the strip S (see FIGS. 2, 5, and 8).

When the first wiping member 12 extends over both ends of the strip S in the strip width direction, the liquid wiped by the first wiping member 12 tends to move to a strip end side and fall from the strip end, and tends to adhere to the end face Se of the strip S in the strip width direction. In this regard, according to the above-described embodiments, since the third wiping member 30 is disposed downstream of the first wiping member 12 extending from the first end E1 to the second end E2 in the strip width direction of the strip S, it is possible to more effectively remove the liquid adhering to the end face Se of the strip S in the strip width direction.

Hereinafter, the overview of the wiping apparatus and the rolling facility according to some embodiments will be described.

(1) A wiping apparatus (10) according to at least one embodiment of the present invention is a wiping apparatus for removing a liquid from a surface of a strip (S) of metal being conveyed, including: a first wiping member (12) disposed to be contactable with a rolled face (Sa, Sb) of the strip. The first wiping member has an oblique portion (20) extending in a direction oblique to a strip width direction of the strip.

According to the above configuration (1), since the first wiping member has the oblique portion extending in the direction oblique to the strip width direction, the liquid removed from the surface of the strip by the first wiping member and the foreign matter contained in the liquid are less likely to accumulate upstream of the first wiping member and more likely to be discharged along the oblique portion of the first wiping member toward lateral to the strip. Therefore, according to the above configuration (1), it is possible to facilitate discharge of the foreign matter (a solid matter (such as metal powder etc. generated by wear of the mill roll or the strip, or wear debris etc. of the wiping member) mixed in the coolant) contained in the liquid. Therefore, it is possible to effectively suppress the scratch on the surface of the strip due to the foreign matter accumulating upstream of the first wiping member.

In the present specification, of the surface of the strip, a face to be rolled by the mill roll or a face rolled by the mill roll (a face in contact with an outer circumferential surface of the mill roll) is referred to as the rolled face.

(2) In some embodiments, in the above configuration (1), the first wiping member includes a first oblique portion (20A) located on a first end (E1) side of the strip in the strip width direction, and a second oblique portion (20B) located on a second end (E2) side of the strip in the strip width direction, the first oblique portion extends in a direction oblique toward downstream in a conveying direction of the strip, from the second end side toward the first end side in the strip width direction, and the second oblique portion extends in a direction oblique toward downstream in the conveying direction of the strip, from the first end side toward the second end side in the strip width direction.

According to the above configuration (2), the first wiping member includes the first oblique portion located on the first end side of the strip and extending in the direction oblique toward downstream in the conveying direction of the strip from the second end side toward the first end side in the strip width direction of the strip, and the second oblique portion located on the second end side of the strip and extending in the direction oblique toward downstream in the conveying direction of the strip from the first end side toward the second end side in the strip width direction of the strip. Therefore, the liquid removed from the surface of the strip by the first wiping member and the foreign matter contained in the liquid are more likely to be discharged along the first wiping member toward both laterals to the strip. Therefore, according to the above configuration (2), it is possible to more effectively discharge the foreign matter contained in the liquid. Therefore, it is possible to more effectively suppress the scratch on the surface of the strip due to the foreign matter accumulating upstream of the first wiping member.

(3) In some embodiments, in the above configuration (1) or (2), the wiping apparatus includes: a first drive part for moving the first wiping member along the strip width direction.

According to the above configuration (3), by moving, along the strip width direction, the first wiping member extending along the direction oblique to the strip width direction, the liquid accumulating upstream of the first wiping member and the foreign matter contained in the liquid can be pushed out toward lateral to the strip. Therefore, it is possible to more effectively discharge the foreign matter contained in the liquid, and it is possible to more effectively suppress the scratch on the surface of the strip due to the foreign matter accumulating upstream of the first wiping member.

(4) In some embodiments, in any of the above configurations (1) to (3), the wiping apparatus includes: a second wiping member (22) disposed to be contactable with the rolled face of the strip in a region including an end portion of the strip in the strip width direction.

According to the above configuration (4), since the wiping apparatus includes the first wiping member, and the second wiping member disposed in the region including the end portion of the strip in the strip width direction (end portion region), it is possible to individually replace the first wiping member and the second wiping member. Therefore, only the worn wiping member can selectively be replaced, making it possible to suppress cost compared to a configuration that requires replacement of the entire wiping member.

(5) In some embodiments, in the above configuration (4), the second wiping member is disposed downstream of the first wiping member in the conveying direction of the strip, and is disposed so as to partially overlap the first wiping member in the strip width direction.

With the above configuration (5), since the second wiping member is disposed so as to partially overlap the first wiping member in the strip width direction, it is possible to improve wiping efficiency in the end portion region of the strip.

(6) In some embodiments, in the above configuration (4), the second wiping member is disposed adjacent to the first wiping member in an extension direction of the first wiping member.

According to the above configuration (6), it is possible to obtain the wiping apparatus with the simple configuration in which the first wiping member and the second wiping member are adjacent to each other in the extension direction of the first wiping member. Therefore, for example, it is possible to easily perform maintenance of the wiping apparatus.

(7) In some embodiments, in any of the above configurations (4) to (6), the wiping apparatus includes: a second drive part for moving the second wiping member along the strip width direction.

According to the above configuration (7), wear of the second wiping member can be dispersed by moving the second wiping member along the strip width direction. Therefore, it is possible to reduce the replacement frequency of the second wiping member.

(8) In some embodiments, in any of the above configurations (4) to (7), the second wiping member has a circular cross-sectional contour along a horizontal direction.

According to the above configuration (8), since the second wiping member has the circular cross-sectional contour along the horizontal direction, the end portion region of the strip can be wiped more widely. Further, wear of the second wiping member can be dispersed by disposing the second wiping member such that the second wiping member rotates around the rotational axis along the vertical direction. Therefore, it is possible to reduce the replacement frequency of the second wiping member.

(9) In some embodiments, in any of the above configurations (1) to (8), the first wiping member has a flat face (14) contactable with the rolled face of the strip, and an upstream face (15) connected to the flat face at an upstream end of the flat face in a conveying direction of the strip, and an angle (φ1) between the flat face and the upstream face is greater than 0 degrees and less than 90 degrees in a cross section orthogonal to the strip width direction of the strip.

According to the above configuration (9), the angle (hereinafter, the angle φ1) between the flat face and the upstream face of the first wiping member is greater than 0 degrees and less than 90 degrees in the cross section orthogonal to the strip width direction. That is, an angle (hereinafter, the angle φ2) between the upstream face of the first wiping member and a portion, of the rolled face of the strip, upstream of the wiping member is an obtuse angle in the above-described cross section. Therefore, compared to a case where the angle φ2 is not greater than 90 degrees, the liquid and the foreign matter contained in the liquid are easily discharged from a region between the upstream face of the wiping member and the rolled face of the strip. Therefore, it is possible to more effectively suppress the scratch on the surface of the strip due to the foreign matter accumulating upstream of the first wiping member.

(10) In some embodiments, in any of the above configurations (1) to (9), the wiping apparatus includes: a third wiping member (30) disposed to be contactable with an end face (Se) of the strip in the strip width direction.

In the above configuration (10), since the third wiping member is disposed which is contactable with the end face of the strip in the strip width direction, it is possible to effectively remove the liquid adhering to the end face of the strip in the strip width direction.

(11) In some embodiments, in the above configuration (10), the wiping apparatus includes: a first elastic member (for example, the above-described spring 56) configured to press the third wiping member toward the end face of the strip.

According to the above configuration (11), since the third wiping member is pressed toward the end face of the strip by the first elastic member, even if the strip moves in the strip width direction due to, for example, meandering of the strip, the third wiping member follows the movement of the strip, making it possible to maintain a state where the third wiping member is in contact with the end face of the strip. Therefore, the liquid adhering to the end face of the strip in the strip width direction can be removed more reliably.

(12) In some embodiments, in the above configuration (10) or (11), the wiping apparatus includes: a flat plate part (50) extending along a strip thickness direction of the strip and configured to support the third wiping member; and a clamping part (51) supported by the flat plate part and configured to clamp the strip from the strip thickness direction.

According to the above configuration (12), a posture of the third wiping member with respect to the strip can be stabilized by clamping the strip from the strip thickness direction by the clamping part supported by the flat plate part. Whereby, the state where the third wiping member is in contact with the end face of the strip is maintained easily, making it possible to more reliably remove the liquid adhering to the end face of the strip in the strip width direction.

(13) In some embodiments, in the above configuration (12), the clamping part includes a pair of clamping members (52) disposed on both sides of the strip in the strip thickness direction of the strip, and the wiping apparatus includes: a second elastic member (for example, the above-described spring 58) for applying, to the pair of clamping members, a biasing force in a direction in which the pair of clamping members separate from each other; and an actuator for applying, to the pair of clamping members, a force opposite in direction to the biasing force.

According to the above configuration (13), the strip can be clamped with the clamping part from the strip thickness direction of the strip by operating the actuator to apply a force greater than the biasing force of the second elastic member to the clamping members. Furthermore, the clamping of the strip with the clamping part can be released by operating the actuator and making the force applied by the actuator to the clamping members smaller than the biasing force of the second elastic member. Thus, according to the above configuration (13), it is possible to flexibly operate the clamping part.

(14) In some embodiments, in any of the above configurations (10) to (12), the third wiping member is disposed downstream of the first wiping member in a conveying direction of the strip.

According to the above configuration (14), since the third wiping member for wiping the end face of the strip in the strip width direction is disposed downstream of the first wiping member for wiping the rolled face of the strip, the liquid etc. laterally discharged from the rolled face of the strip by the first wiping member and adhering to the end face of the strip can effectively be removed by the third wiping member.

(15) A rolling facility (1) according to at least one embodiment of the present invention, includes: a mill roll (2) for rolling a strip of metal; and the wiping apparatus (10) according to any one of the above (1) to (14), which is disposed downstream of the mill roll in a conveying direction of the strip.

According to the above configuration (15), since the first wiping member extends in the direction oblique to the strip width direction, the liquid removed from the surface of the strip by the first wiping member and the foreign matter contained in the liquid are less likely to accumulate upstream of the first wiping member and more likely to be discharged along the first wiping member toward lateral to the strip. Therefore, according to the above configuration (15), it is possible to facilitate discharge of the foreign matter (a solid matter (such as metal powder etc. generated by wear of the mill roll or the strip, or wear debris etc. of the wiping member) mixed in the coolant) contained in the liquid. Therefore, it is possible to effectively suppress the scratch on the surface of the strip due to the foreign matter accumulating upstream of the first wiping member.

Embodiments of the present invention were described in detail above, but the present invention is not limited thereto, and also includes an embodiment obtained by modifying the above-described embodiments and an embodiment obtained by combining these embodiments as appropriate.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, an expression of a shape such as a rectangular shape or a cylindrical shape shall not be construed as only the geometrically strict shape, but also includes a shape with unevenness or chamfered corners within the range in which the same effect can be achieved.

As used herein, the expressions "comprising", "including" or "having" one constitutional element is not an exclusive expression that excludes the presence of other constitutional elements.

REFERENCE SIGNS LIST

1 Rolling facility
2 Mill roll
4 Rolling mill
6 Guide roll
8 Winding device
10 Wiping apparatus
12 First wiping member
14 Flat face
15 Upstream face
20 Oblique portion
20A First oblique portion
20B Second oblique portion
22 Second wiping member
22A Second wiping member
22B Second wiping member
24 Holding member
28 Side wiper
30 Third wiping member
32 Flat face
50 Flat plate part
51 Clamping part
52 Clamping member
54 Portion
56 Spring (first elastic member)
58 Spring (second elastic member)
E1 First end
E2 Second end
O Rotational axis
S Strip
Sa Rolled face
Sb Rolled face
Se End face

The invention claimed is:

1. A wiping apparatus for removing a liquid from a surface of a strip of metal being conveyed, comprising:

a first wiping member disposed to be contactable with a rolled face of the strip, wherein the first wiping member has an oblique portion extending in a direction oblique to a strip width direction of the strip, wherein the wiping apparatus further comprises a pair of second wiping members provided separately from the first wiping member and disposed to be contactable with the rolled face of the strip in regions including opposite end portions of the strip in the strip width direction, respectively, and wherein each of the pair of second wiping members has a circular cross-sectional contour along a horizontal direction.

2. The wiping apparatus according to claim 1, wherein the first wiping member includes a first oblique portion located on a first end side of the strip in the strip width direction, and a second oblique portion located on a second end side of the strip in the strip width direction, wherein the first oblique portion extends in a direction oblique toward downstream in a conveying direction of the strip, from the second end side toward the first end side in the strip width direction, and wherein the second oblique portion extends in a direction oblique toward downstream in the conveying direction of the strip, from the first end side toward the second end side in the strip width direction.

3. The wiping apparatus according to claim 1, comprising:

a first drive part for moving the first wiping member along the strip width direction.

4. The wiping apparatus according to claim 1, wherein each of the pair of second wiping members is disposed downstream of the first wiping member in a conveying direction of the strip, and is disposed so as to partially overlap the first wiping member in the strip width direction.

5. The wiping apparatus according to claim 1, wherein each of the pair of second wiping members is disposed adjacent to the first wiping member in an extension direction of the first wiping member.

6. The wiping apparatus according to claim 1, comprising:

a second drive part for moving each of the pair of second wiping members along the strip width direction.

7. The wiping apparatus according to claim 1, wherein the wiping apparatus further comprises a third wiping member disposed to be contactable with an end face of the strip in the strip width direction, the third wiping member having a flat face contactable with the end face and extending along a plane perpendicular to the strip width direction.

8. The wiping apparatus according to claim 7, comprising:

a first elastic member configured to press the third wiping member toward the end face of the strip.

9. The wiping apparatus according to claim 7, wherein the third wiping member is disposed downstream of the first wiping member in a conveying direction of the strip.

10. A rolling facility, comprising:

a mill roll for rolling a strip of metal; and the wiping apparatus according to claim 1, which is disposed downstream of the mill roll in a conveying direction of the strip.

11. A wiping apparatus for removing a liquid from a surface of a strip of metal being conveyed, comprising:

a first wiping member disposed to be contactable with a rolled face of the strip, wherein the first wiping member has an oblique portion extending in a direction oblique to a strip width direction of the strip, wherein the first wiping member has a flat face contactable with the rolled face of the strip, and an upstream face connected to the flat face at an upstream end of the flat face in a conveying direction of the strip, wherein an angle between the flat face and the upstream face is greater than 0 degrees and less than 90 degrees in a cross section orthogonal to the strip width direction of the strip, and wherein the wiping apparatus is configured such that an angle between the upstream face and a portion of the rolled face upstream of the first wiping member is an obtuse angle in the cross section.

12. A rolling facility, comprising:

a mill roll for rolling a strip of metal; and the wiping apparatus according to claim 11, which is disposed downstream of the mill roll in a conveying direction of the strip.

13. A wiping apparatus for removing a liquid from a surface of a strip of metal being conveyed, comprising:

a first wiping member disposed to be contactable with a rolled face of the strip, wherein the first wiping member has an oblique portion extending in a direction oblique to a strip width direction of the strip, where the wiping apparatus further comprises a third wiping member disposed to be contactable with an end face of the strip in the strip width direction, the third wiping member having a flat face contactable with the end face and extending along a plane perpendicular to the strip width direction, and wherein the wiping apparatus comprising:

a flat plate part extending along a strip thickness direction of the strip and configured to support the third wiping member; and a clamping part supported by the flat plate part and configured to clamp the strip from the strip thickness direction.

14. The wiping apparatus according to claim 13, wherein the clamping part includes a pair of clamping members disposed on both sides of the strip in the strip thickness direction of the strip, and wherein the wiping apparatus comprises:

a second elastic member for applying, to the pair of clamping members, a biasing force in a direction in which the pair of clamping members separate from each other; and an actuator for applying, to the pair of clamping members, a force opposite in direction to the biasing force.

15. A rolling facility, comprising:

a mill roll for rolling a strip of metal; and the wiping apparatus according to claim 13, which is disposed downstream of the mill roll in a conveying direction of the strip.

* * * * *